US006598856B1

(12) United States Patent
Puff et al.

(10) Patent No.: US 6,598,856 B1
(45) Date of Patent: Jul. 29, 2003

(54) PORTABLE HYDRAULIC POWERED STAKE PULLER

(76) Inventors: Kenneth E. Puff, 802 Syska Rd., Ossining, NY (US) 10562; Erwin B. Puff, 210 Chadeayne Rd., Ossining, NY (US) 10562; Eric W. Jaslow, P.O. Box 392, Tomkins Cove, NY (US) 10986

( * ) Notice: Subject to any disclaimer, the term of this patent is extended or adjusted under 35 U.S.C. 154(b) by 0 days.

(21) Appl. No.: 10/090,187

(22) Filed: Mar. 4, 2002

(51) Int. Cl.[7] ..... B25C 11/00
(52) U.S. Cl. ..... 254/18; 254/30
(58) Field of Search ..... 254/18, 30, 132, 254/133, 93 R, 29 R, 31, 93 H, 89 H

(56) References Cited

U.S. PATENT DOCUMENTS

| | | | | | |
|---|---|---|---|---|---|
| 2,570,914 | A | * | 10/1951 | Buck | 254/30 |
| 2,797,889 | A | * | 7/1957 | Talboys | 254/30 |
| 3,165,295 | A | * | 1/1965 | Nolden | 254/2 |
| 3,773,292 | A | * | 11/1973 | Thiermann | 254/30 |
| 4,078,766 | A | * | 3/1978 | Saurwein | 254/18 |
| 4,804,165 | A | * | 2/1989 | Pippin | 254/30 |
| 5,566,924 | A | * | 10/1996 | Shirk | 254/18 |
| 5,704,591 | A | * | 1/1998 | Byrne | 254/18 |
| 5,924,679 | A | * | 7/1999 | Wilson | 254/18 |
| 6,113,073 | A | * | 9/2000 | Lefavour | 254/18 |
| 6,398,188 | B1 | * | 6/2002 | Salman | 254/30 |

* cited by examiner

*Primary Examiner*—Joseph J. Hail, III
*Assistant Examiner*—Daniel Shanley
(74) *Attorney, Agent, or Firm*—Darby & Darby

(57) ABSTRACT

A portable hydraulic stake puller includes a hydraulic cylinder that extends to raise a jaw assembly. The jaw assembly pivots, while being raised, to grab and trap the stake. A grab hook may alternatively extract similar items not readily removable with the jaw assembly. The jaw or chain tension is controllably released when the control lever is released at any height of the stroke. Squeezing the control lever can again attain grip easily. The gripping action of the jaw is attained by at least friction against the jaw. When the control lever is released, the entire lift assembly returns to the neutral position under a spring tension. The hydraulic stake puller is mounted on wheels and controlled via handles allowing easy maneuvering.

10 Claims, 4 Drawing Sheets

PORTABLE HYDRAULIC POWERED STAKE PULLER

BACKGROUND OF THE INVENTION

1. Field of the Invention

The present invention relates to portable hydraulic stake puller. More specifically, the present invention relates to a portable hydraulic stake puller useful for removing tent stakes, ground rods, fence posts, sign posts, and the like.

2. Description of the Related Art

Pulling tent stakes out of the ground can be a task more difficult than many people realize. This is mostly because, in the world of commerce, tent stakes are not the short thin rods that are used for camping tents. Instead, when used for large commercial tents and structures, such as those rented for parties, large sales events and other special events, tent stakes are typically one inch to one and one quarter inch diameter rods (or larger) constructed of, for example, reinforcing rods such as is used for concrete, carbon steel, or wood. These stakes have a length that is usually in excess of two feet.

A hammering device is often used to pound this type of stake into asphalt paving or hard ground. Such a driven stake cannot be pulled from the ground by hand by merely loosening it with a few blows against its exposed top, or by turning the top with a turning device such as a wrench. Removal of these types of stakes is very difficult.

Perhaps the most similar task to pulling such large tent stakes is that of pulling railroad tie spikes. In that situation, although railroad tie spikes are not as long as large tent stakes, and the removal force potentially less, the difficulty is similar. The major difference between removing spikes from railroad ties and pulling large tent stakes from the ground is the availability of powerful machines for easy removal. On the railroad, there are machines movable only along the railroad tracks which remove the spikes. Unfortunately, there is a lack of means for providing a powerful tent stake pulling machine, often times in remote locations with poor access, and no or only limited access to power sources.

For example, conventional railroad spike pullers use pneumatic power. This requires a nearby source of power, of significant weight, and hoses which must be moved between the locations of the spikes to be removed. Such an arrangement is extremely difficult to obtain at typically isolated sites at which large tents are erected.

OBJECTS AND SUMMARY OF THE INVENTION

It is an object of the present invention to provide a portable hydraulic stake pulling apparatus which overcomes the foregoing problems.

It is a further object of the present invention to provide a portable hydraulic stake pulling apparatus which has its own integrated power source and which can be operated by one person is swift and easy precision.

It is a further object of the present invention to provide a portable hydraulic stake puller which can be positioned to grab a stake for removal with a simple twist of the handles, allowing rapid removal of multiple stakes.

It is a further object of the present invention to provide a portable hydraulic stake puller which can be easily and readily loaded into and transported in a truck.

It is a further object of the present invention to provide a portable hydraulic stake puller which can be swiftly and readily adapted for use in removing fence posts, or other items to be withdrawn from a surface.

Briefly stated, the present invention provides a portable hydraulic stake puller powered by an engine. The lifting action is produced by the extension of a hydraulic cylinder that extends to raise a jaw assembly. The jaw assembly pivots, while being raised, to grab the stake. A grab hook is also provided for use to extract similar items such as fence posts, signposts, grounding rods, spikes, pins, pipes, etc. The jaw or chain tension is released when the control lever is released at any height of the stroke. Squeezing the control lever can again attain grip. The gripping action of the jaw is attained by at least friction. The entire lift assembly returns to the neutral position, when the control lever is released, by the use of springs. The hydraulic stake puller is mounted on wheels and controlled via handles.

According to an embodiment of the present invention, there is provided a hydraulic stake pulling apparatus, comprising, an engine mounted on a frame, a hydraulic pump driven by the engine, a hydraulic fluid valve selectable between an open position and a neutral position, the open position communicating hydraulic fluid to a hydraulic cylinder, a jaw attached to the hydraulic cylinder, the jaw having a guide slot for positioning the stake therein, and a control lever for selecting one of the open position and the neutral position, whereby, in the open position, the hydraulic cylinder is actuated, driving the jaw to lift the stake.

According to another embodiment of the present invention, there is provided a hydraulic stake pulling apparatus further comprising, a lifting tube, attached to the hydraulic cylinder, positioned between the jaw and the hydraulic cylinder, and a grab hook mounted on the lifting tube, whereby an attachment member may be used to link the grab hook with the stake, thereby removing the stake when the lifting tube is raised by the hydraulic cylinder.

According to another embodiment of the present invention, there is provided a hydraulic stake pulling apparatus, wherein the hydraulic cylinder is mounted in and guided by a tube running in the lifting direction of the hydraulic According to another embodiment of the present invention, there is provided a hydraulic stake pulling apparatus, wherein the jaw is at least hard faced, providing improved friction with the stake during a lifting operation of the jaw.

According to another embodiment of the present invention, there is provided a hydraulic stake pulling apparatus further comprising, at least one spring member, and the spring member providing resiliency to return the jaw to an original position after the control lever is released and the valve is in the neutral position.

According to another embodiment of the present invention, there is provided a hydraulic stake pulling apparatus, wherein the engine is a gasoline engine.

According to another embodiment of the present invention, there is provided a hydraulic stake pulling apparatus further comprising, a gear box or hydraulic mechanism controllably linking and connecting the engine with the hydraulic pump.

According to another embodiment of the present invention, there is provided a hydraulic stake pulling apparatus further comprising, further comprising a flexible coupling connecting the engine with the hydraulic pump.

According to another embodiment of the present invention, there is provided a hydraulic stake pulling apparatus further comprising, a cover encasing at least the hydraulic pump and the valve, whereby the hydraulic pump and the valve receive protective cover from environmental damage.

According to another embodiment of the present invention, there is provided a hydraulic stake pulling apparatus, wherein the jaw is at least one of being mounted partially pivotably and mounted partially slidably on the lifting tube.

According to another embodiment of the present invention, there is provided a hydraulic stake pulling apparatus further comprising, at least two wheels attached on the frame, at least two handles attached to the frame, and the control lever is mounted on one of the handles.

According to another embodiment of the present invention, there is provided a method for removing stakes, comprising, driving a hydraulic pump with an engine, connecting a hydraulic cylinder to a valve on the hydraulic pump, opening the valve with a control lever, the opening causing the hydraulic cylinder to extend, providing a jaw on the hydraulic cylinder, the jaw having a guide slot for inserting the stake, removing the stake inserted in the guide slot when the jaw is raised by the hydraulic cylinder.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
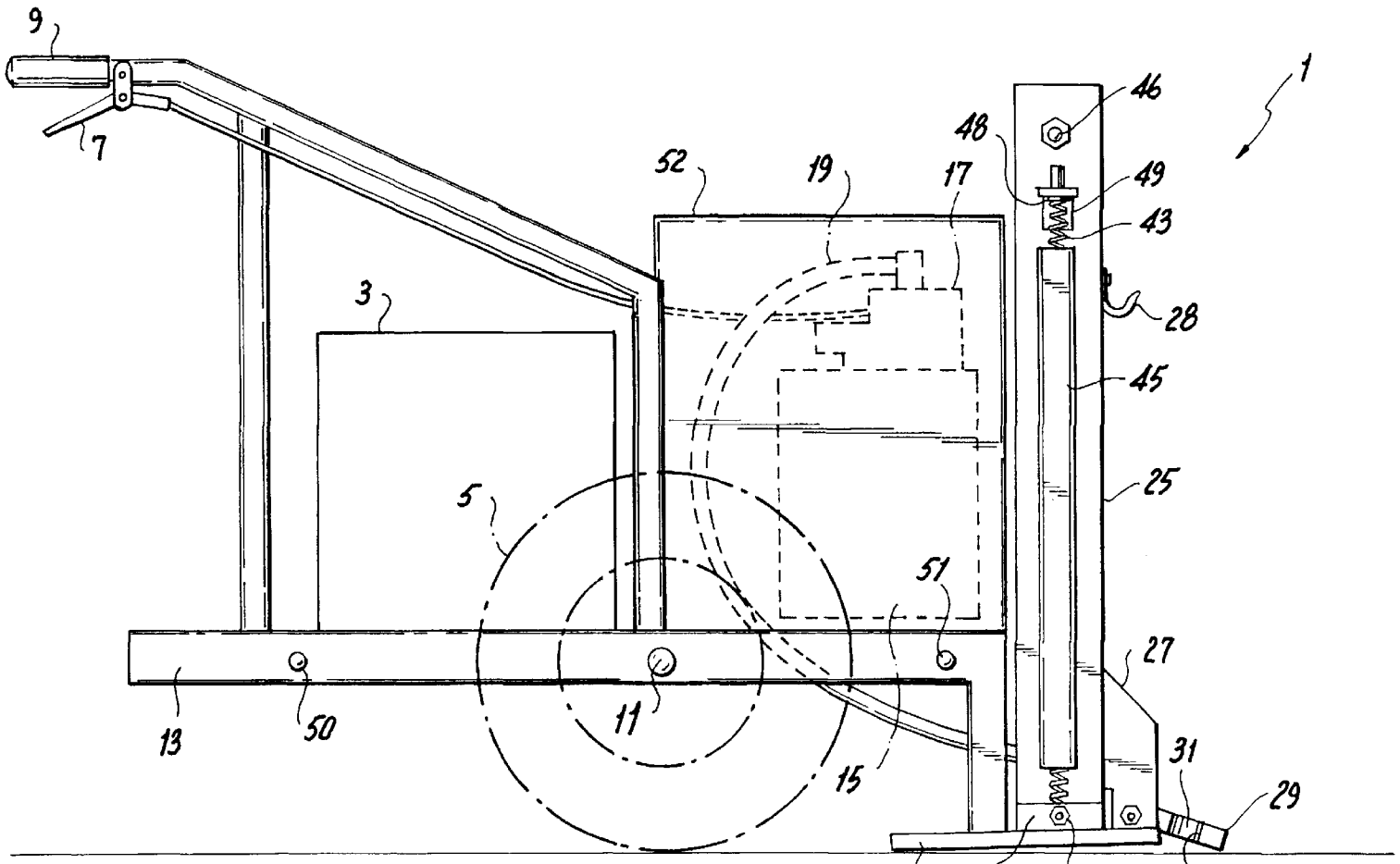
FIG. 1 is a side view drawing of the hydraulic pulling device according to the present invention.

Referring to FIG. 1, the present invention is a hydraulic powered stake puller 1 that is able to be operated by a single user. An engine 3, mounted on a frame 13, provides the necessary power to operate the unit. Engine 3 is preferably at least a 4 horsepower engine (gasoline engine), and more preferably at least a 5.5 horsepower engine, operating at about 3600 rpm. Stake puller 1 is preferably mounted on wheels 5, allowing for flexibility and portability for use in many diverse stake pulling situations.

Furthermore, wheels 5 are optionally driven by engine 3 by any conventional self-propel means. For example, the user engages the self-propel means by gripping a control lever 7 on one of handle members 9. Moreover, wheels 5 are optionally braked by any conventional means, such as direct restriction of the wheel itself or by mechanical locking of a wheel axle 11.

A hydraulic pump 15, mounted on frame 13, is driven by engine 3. A valve 17 releases hydraulic fluid pressure generated by hydraulic pump 15 into a hydraulic line 19. Valve 17 is opened and closed through control lever 7 mounted on one of handle members 9.

Figure 2:
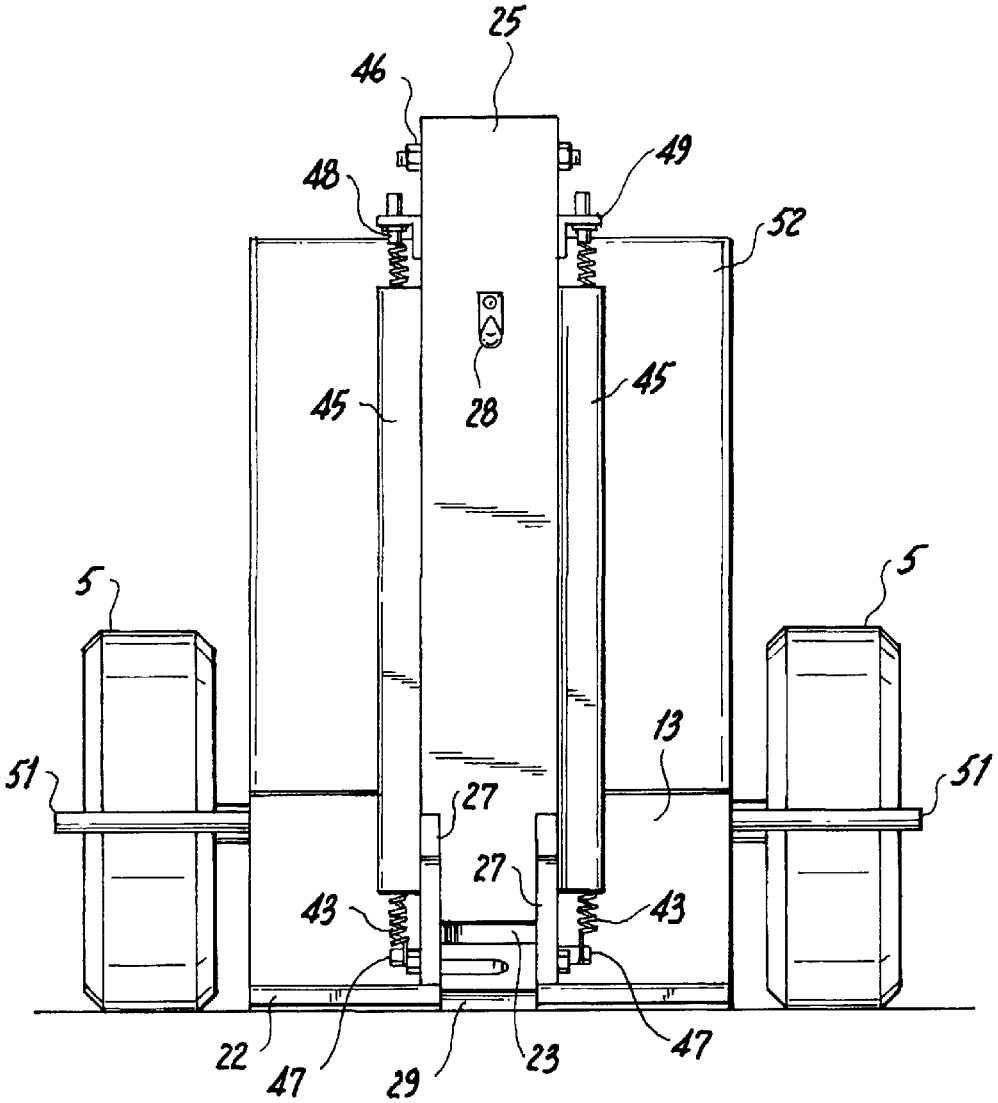
FIG. 2 is a detailed drawing of a lift tube of the hydraulic pulling device of FIG. 1.
Figure 3A:
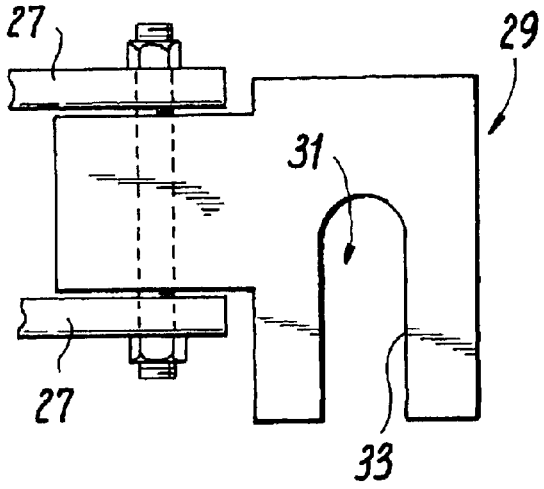
FIG. 3(A) is a plan view of the lifting jaw in a neutral position according to the present invention.
Figure 3B:
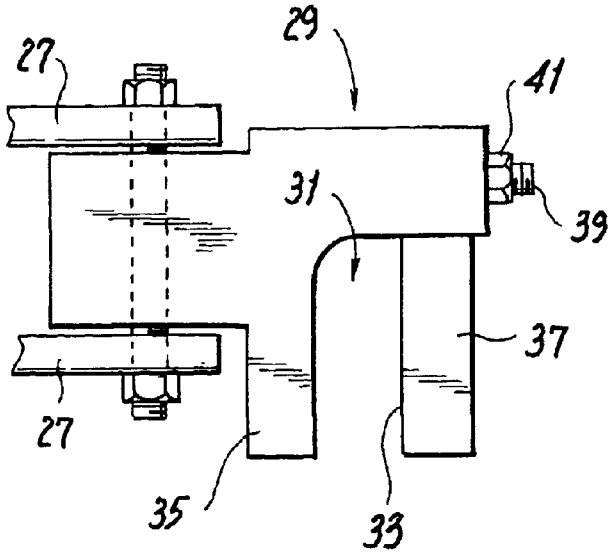
FIG. 3(B) is a plan view of an alternate embodiment of the lifting jaw according to the present invention.
Figure 4:
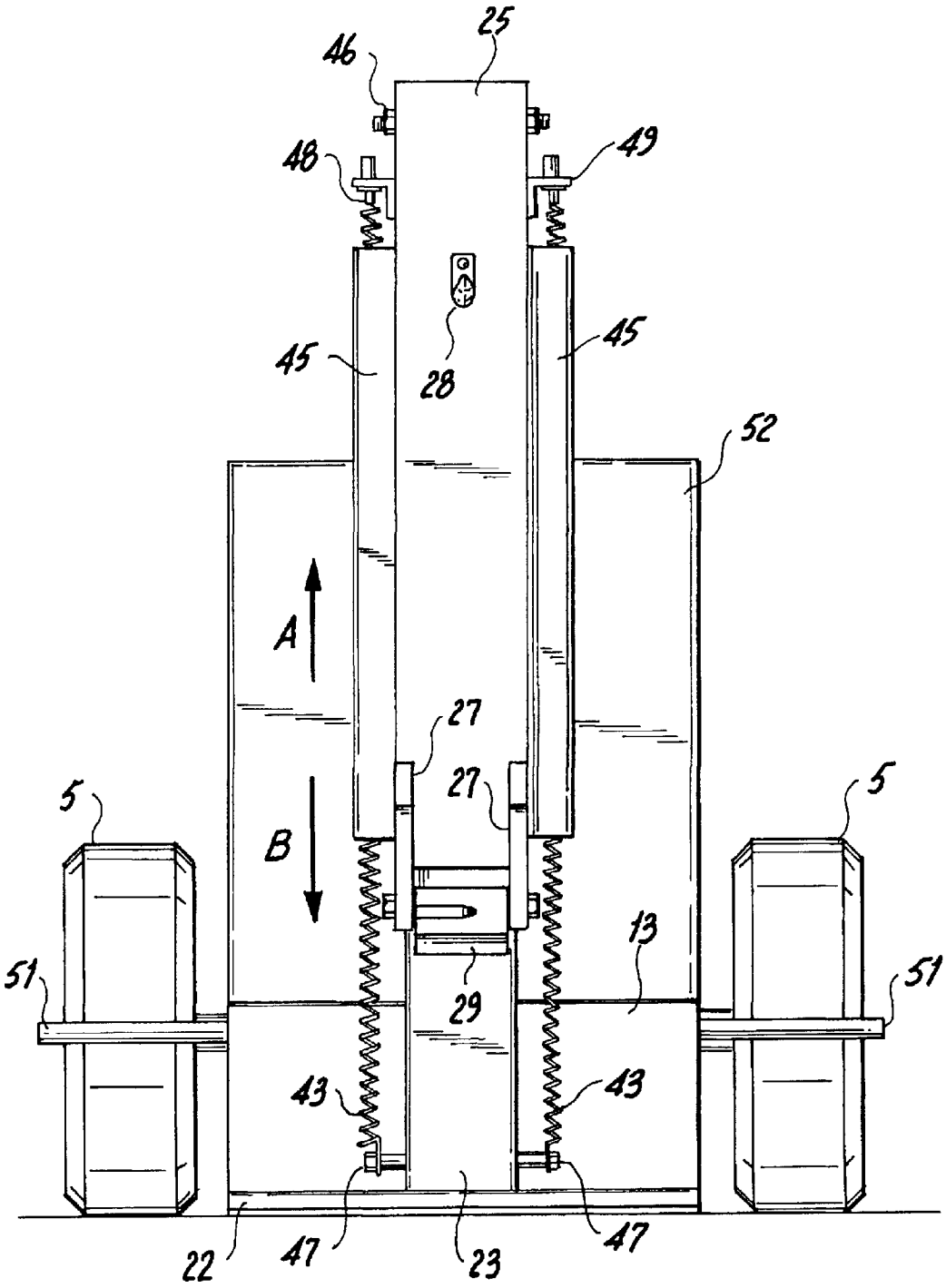
FIG. 4 is a partial front view of the hydraulic pulling device of FIG. 2 in a partially extended position.

Additionally referring now to FIGS. 2–4, hydraulic line 19 attaches to a hydraulic cylinder 21 and is positioned within an inner tube member 23. Inner tube member 23 operates to support and protect hydraulic cylinder 21 during operation.

A base member 22 supports hydraulic cylinder 21 and inner tube member 23, and operates to support the unit in operation and spread the pressure during operation over a broader surface area of the ground. Base member 22 may be in any convenient shape but must be strong enough to prevent bending during use and provide sufficient support for proper operation.

Hydraulic fluid pressure, introduced into hydraulic line 19 through valve 17, causes hydraulic cylinder 21 to extend and move in the direction indicated by arrow A in FIG. 4.

Hydraulic cylinder 21 includes an extendable member having an end attachment part (not shown). A telescopic lifting tube 25, fits over and guidably slides around inner tube member 23, and is attached to the end attachment part of hydraulic cylinder 21 with a first attachment member 46.

Telescopic lifting tube 25 provides protection to hydraulic cylinder 21 during use and transfers the force from hydraulic cylinder 21 to the jaws or lifting member during lifting, as will be explained.

At the bottom of inner tube member 23, a second attachment member 47 extends through inner tube member 23, and serves to secure the bottom ends of a pair of spring members 43, 43, as will be explained.

A pair of spring tubes 45, 45 extend along the outside of lifting tube 25 and guide spring members 23 during operation and use.

A pair of support brackets 49, 49 extend away from the outside of lifting tube 25, above respective spring tubes 45, 45. A pair of third attachment members 48, 48 operate to join top portions of spring members 43, 43 to support brackets 49, 49. Spring members 43, 43 are respectively adjustably retained between third attachment members 48, 48 and second attachment members 47, 47. Third attachment members 48, 48 are adjustable relative to support brackets 49, 49 to adjust the spring tension of spring members 43, 43.

During operation, lifting tube 25 is raised by hydraulic cylinder 21 pressing against the resiliency of spring members 43, 43 operably retained in spring tubes 45, 45. During downward operation, spring members 43, 43 return lifting tube 25 (by elastic urging), in a direction indicated by arrow B in FIG. 4 to its starting position (shown in FIG. 2). This operation occurs when control lever 7 is released, allowing valve 17 to return from an open position to a neutral position.

A pair of support members 27, 27 extend outward away from lifting tube 25 and optionally retain and support a jaw 29 for removal of stakes. A grab hook 28 is preferably mounted on lifting tube 25 above support members 27, 27. Grab hook 28 may be alternatively positioned anywhere along the length of lifting tube 25 or even on support members 27, 27 themselves dependant upon customer need.

Grab hook 28 may be particularly useful when jaw 29 cannot reach, access, or grip the stake to be removed. In these cases, a chain or sling (not shown) may be attached to grab hook 28 and then to the stake or other item to be raised. For example, while removing a 4×4 fence post from the ground, a sling or chain may be wrapped around the post and then hooked to grab hook 28. During lifting, the sling or chain may be readjusted around the post as it rises from the ground. Thus, the present invention provides safe and easy removal a plurality of items useful to customers.

A first set of lifting members 50 is mounted on frame 13 in a rear position and a second set of lifting members 51 is mounted on frame 13 in a front position proximate lifting tube 25. Lifting members extend from frame 13 and allow an operator or a pair of operators to lift hydraulic stake puller 1 into, for example, a pick-up truck for easy transportation to a distant job cite.

Jaw 29 is removably mounted on lifting tube 25, between supports 27, 27. In the present embodiment a bolt (shown but not numbered) pivotably retains jaw 29. A choice of jaw sizes is available depending upon the particular application required by the client. Jaw 29 is preferably partially pivotably mounted on lifting tube 25. This pivoting action allows jaw 29, having been placed around a stake, to pivot upon lifting and trap the stake between edges in a guide slit 31.

In a first embodiment of jaw 29, shown in FIG. 3A, guide slit 31, may have roughened or hardened surfaces 33 to improve grip during pulling and minimize damage during extended ware.

In a second embodiment of jaw 29, shown in FIG. 3B, jaw 29 may be optionally provided with one fixed head 35 and one adjustable head 37. Adjustable head 37 is adjustable relative to fixed head 35 thereby allowing for varying dimensions of guide slot 31. Movement of adjustable head 37, relative to fixed head 35, may be attained by any convenient means, such as a screw member 39 and locking nut 41.

Operation of the Device

The stake puller according to the present invention is wheeled to a location where stakes are required to be removed. The stake is inserted into the guide slot of the jaw and secured. The stake maybe secured by a simple twist of the stake puller machine, lodging the stake within the guide slit, or by attaching to a hook.

The user then squeezes the control lever, opening the valve, whereby the hydraulic pump generates pressurized hydraulic fluid through the hydraulic fluid line to the hydraulic cylinder. The hydraulic cylinder raises the lifting tube to which is attached the jaw. The surfaces of the jaw engage and hold the stake through rotation while the lifting tube raises. When the user releases the control, the valve returns from an open position to a neutral position. The spring members then guide the lifting tube and jaw to their starting positions.

Should the stake, such as a ground rod, be longer than the lifting capacity of the stake puller (which, in a preferred embodiment of the present invention, is at least 20 inches), once the stake puller removes the stake through its lifting capacity, the user releases the control lever, causing the lifting tube and jaw to return to the starting position. The user may then insert the ground rod into the guide slot of the jaw, and repeat the lifting process until the desired length of the rod is removed. As noted, alternatively a sling may be attached to the item to be removed and attached to the grab hook and alternatively readjusted after each pull stroke until the item is completely removed.

Alternative embodiments of the present invention are envisioned. For example, a hydraulic or mechanical vibration mechanism may be added to the stake puller, causing at least the jaw of the puller to vibrate. Such vibrations will assist in loosening the stake as it is being pulled.

Additionally, fold-stabilizing legs attached to either base member 22 or other member of hydraulic stake puller 1 and brace the device against twisting or shifting on an unstable surface during stake removal.

The present invention is preferably designed with at least a 4 horsepower gas engine, and more preferably at least about a 5.5 horsepower engine. However, any effective type of engine may be used to power the hydraulic pump. Diesel or electric engines may be substituted, so long as they are able to support the operation of the hydraulic pump.

The jaw of the present invention is shown as a V-type or C-type claw member. However, any suitable gripping means may be used, as long as it is adequate to grip and retain the stake as it is being removed. The present simple design provides great convenience and speed to the user, but the alternative embodiments with adjustable jaws, clamps, or hooks are readily adaptable by a user according to need.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A hydraulic stake pulling apparatus, comprising:

an engine mounted on a mobile frame;

a hydraulic pump operably driven by said engine;

a hydraulic fluid valve selectable between an open position and a neutral position;

said open position communicating hydraulic fluid to a hydraulic cylinder mounted in said frame;

at least a lifting tube operably attached to said hydraulic cylinder;

said hydraulic cylinder operably supported by a base member;

said lifting tube operable away from said base member during a use of said hydraulic stake puller apparatus;

at least a first attachment member attached to said lifting tube;

said attachment member being at least one of a jaw member and a hook member;

said attachment member effective to operably receive and retain a stake to be removed during a use of said hydraulic stake puller apparatus;

at least a first spring member operably and elastically joining said base member to said lifting tube; and a control lever for selecting one of said open position and said neutral position of said hydraulic fluid valve during said use, whereby in said open position; said hydraulic cylinder is actuated, extending said hydraulic cylinder upwardly away from said base member and driving said lifting tube to lift said at least first attachment member relative to said base member and in said neutral position said at least first spring member elastically urging said lifting tube toward said base member.

2. The hydraulic stake pulling apparatus according to claim 1, wherein:

said hydraulic cylinder is mounted in and guided during said use by a guide tube running in the lifting direction of said hydraulic cylinder; and said guide tube extending inside said lifting tube away from said base member, whereby said lifting tube and said hydraulic stake puller apparatus is stabilized against shifting during said use.

3. The hydraulic stake pulling apparatus according to claim 2, wherein said jaw is at least hard faced, providing improved friction with said stake during a lifting operation of said jaw.

4. The hydraulic stake pulling apparatus according to claim 1, wherein said engine is a gasoline engine.

5. The hydraulic stake pulling apparatus according to claim 1, further comprising a gear member operably connecting said engine with said hydraulic pump and allowing for safe and speedy operation of said hydraulic pump.

6. The hydraulic stake pulling apparatus according to claim 5, further comprising a flexible safety coupling connecting said engine with said hydraulic pump, whereby said safety coupling provides safety to a user upon a breakage of said engine or said gear member.

7. The hydraulic stake pulling apparatus according to claim 1, further comprising:

a cover;

said cover operably encasing at least said hydraulic pump and said valve, whereby said hydraulic pump and said valve receive protective cover from external environmental or accidental user damage.

8. The hydraulic stake pulling apparatus according to claim 1, further comprising:

at least two wheels attached on said frame;

at least two handles attached to said frame;

said control lever being operably mounted on one of said handles; and at least a first set of lifting members mounted on said frame, whereby said wheels, said handles, and said lifting members allow easy rapid and simple use of said hydraulic stake puller and ready transportation.

9. The hydraulic stake pulling apparatus according to claim 1, further consisting of a hydraulic fluid line disposed between said hydraulic fluid valve and said hydraulic cylinder.

10. A hydraulic stake pulling apparatus, comprising:

an engine mounted on a mobile frame;

a hydraulic pump operably driven by said engine;

a hydraulic fluid valve selectable between an open position and a neutral position;

said open position communicating hydraulic fluid to a hydraulic cylinder mounted in said frame;

at least a lifting tube operably attached to said hydraulic cylinder;

said hydraulic cylinder operably supported by a base member;

said lifting tube operable away from said base member during a use of said hydraulic stake puller apparatus;

at least a first attachment member attached to said lifting tube;

said attachment member being at least one of a jaw member and a hook member; said attachment member effective to operably receive and retain a stake to be removed during a use of said hydraulic stake puller apparatus, wherein said jaw is at least one of being partially pivotably mounted on said lifting tube, whereby said jaw pivots relative to said stake and said lifting tube during said use and traps said stake during operation of said hydraulic cylinder;

at least a first spring member operably and elastically joining said base member to said lifting tube; and a control lever for selecting one of said open position and said neutral position of said hydraulic fluid valve during said use, whereby in said open position, said hydraulic cylinder is actuated, driving said hydraulic cylinder and said lifting tube to lift said at least first attachment member relative to said base member and in said neutral position said at least first spring member elastically urging said lifting tube toward said base member.

* * * * *